United States Patent [19]

Smith

[11] Patent Number: 4,652,069

[45] Date of Patent: Mar. 24, 1987

[54] ELECTRICAL PLUG RETAINING DEVICE

[76] Inventor: Hager L. Smith, 1544 Mainsail Dr., Naples, Fla. 33962

[21] Appl. No.: 801,863

[22] Filed: Nov. 26, 1985

Related U.S. Application Data

[63] Continuation-in-part of Ser. No. 691,478, May 6, 1985, abandoned.

[51] Int. Cl.[4] ..... H01R 13/639

[52] U.S. Cl. ..... 339/75 P; 339/103 R

[58] Field of Search ..... 339/75 P, 103 R

[56] References Cited

U.S. PATENT DOCUMENTS 2,569,037 9/1951 Dalton ..... 339/75 P 4,066,313 1/1978 von dem Hagen ..... 339/75 P

FOREIGN PATENT DOCUMENTS 1152176 8/1983 Canada ..... 339/75 P

OTHER PUBLICATIONS

Popular Mechanics, vol. No. 112, Issue No. 5, 11/1959, p. 164.

*Primary Examiner*—John McQuade

*Attorney, Agent, or Firm*—Willian Brinks Olds Hofer Gilson & Lione

[57] ABSTRACT

A device for ensuring retention of electrical plugs in outlets includes a base plate and a selectively releasable retaining member saddle. The base plate is semi-permanently secured between the face plate of the outlet and the wall. The base plate preferably is rectangular and includes a pair of arms which extend from opposite edges of the base plate and which are perpendicular to the plane of the base plate. The arms each include a complexly configured channel which receives a pair of spaced apart pins extending from the retaining member. The retaining member is generally U-shaped, having parallel sides which slidably engage the base plate arms and a slot centrally disposed on the base of the U-shape which receives a cord. The pins on the retaining member cooperate with the channels in the base plate arms to retain it there, to limit it to pivoting motion to receive a plug and its associated cord and to releasably secure the cordal plug, thereby securing the plug in the outlet.

12 Claims, 4 Drawing Figures

ELECTRICAL PLUG RETAINING DEVICE

CROSS-REFERENCE TO RELATED APPLICATION

This application is a continuation-in-part of application Ser. No. 691,478, filed May 6, 1985, now abandoned.

BACKGROUND OF THE INVENTION

The invention relates generally to an electrical plug retaining device and more specifically to such a device which may be readily adjusted to receive and secure various plug sizes to an associated wall outlet.

The ease with which conventional electrical plugs are connected to standard wall outlets is well known and appreciated. Comparable ease attends the disconnection of such plugs. However, when the disconnection is the result of mis-identification of cords, simple accidental disconnection, mischievous disconnection by children, or similar occurrences, the ease becomes a nuisance. When the disconnected device is simply a lamp or radio, the problem can be quickly corrected. The effect of disconnection upon many types of equipment, particularly electronic equipment is more than a temporary interruption of service. For example, electronic memories in such devices as simple digital clocks, television receivers, and microwave ovens must be reset. Of far greater problematic significance are interruptions to electronic data processing systems, particularly central processing memories. Here the electrical interruption may readily cause the loss of significant data and entail costly re-entry or other consequences attendant the loss of irreplaceable data.

The foregoing examples confirm the necessity of maintaining electrical power to various equipment through the elimination of power plug disconnection. Various devices have been previously proposed with this goal in mind. For example, a brief article appearing in the November, 1959 issue of *Popular Mechanics* (Volume 112, Issue 5) discloses such a device. It comprises an L-shaped bracket which is secured to the wall outlet and a slidable and securable J-shaped component which engages the plug.

U.S. Pat. No. 2,569,037 discloses another locking device for electrical plugs. Here, a stanchion having a plurality of axially spaced-apart slots receives one portion of a double yoke, the other portion of the yoke engaging and restraining the electrical plug. U.S. Pat. No. 4,066,313 teaches a cord restraint device similar to that illustrated in the referenced issue of *Popular Mechanics*. Here, too, a planar bracket is secured to the outlet and receives a sliding, adjustable second member which engages the cord.

Another cord restraint device is illustrated in Canadian Pat. No. 1,152,176. Here, again, a bracket similar to that illustrated in Pat. No. 4,066,313 is secured to the wall outlet. The bracket slidingly receives a plug retaining member. Flexible lugs on the retaining member engage saw teeth on the bracket. Cooperation between the lugs and saw teeth permit translation of the retaining member only toward the plug and wall outlet unless the lugs are manually deflected from engagement with the saw teeth such that the member and plug may be removed.

While each of the foregoing devices provides a plug retention means, they do so with varying degrees of installation and plug securement ease. Several are fabricated of plural components which increases the cost or include removable elements which may be misplaced. From the foregoing, it is apparent that improvements in the art of electrical plug retention devices are not only possible but desirable.

SUMMARY OF THE INVENTION

The present invention relates to a device for securing electrical plugs to outlets and eliminating accidental disconnection. It includes a base plate and a selectively releasable retaining member. The base plate is secured between the cover plate of the outlet and the wall. The base plate is preferably rectangular and defines two apertures which fit about the outlets. A pair of arms extend from opposite edges of the base plate and are oriented perpendicularly to the plane of the base plate. The arms each include a complexly configured channel which receives a pair of spaced apart pins extending from the retaining member. The retaining member is generally U-shaped, having parallel sides which slidably engage the base plate arms and a slot centrally disposed on the base of the U-shape which receives a cord. The pins on the retaining member cooperate with the channels in the base plate arms to retain it thereon, to limit it to pivoting motion to receive a cord and its associated plug and to releasably engage the plug, thereby securing the plug in the outlet.

The base plate and retaining member may be fabricated of a suitable thin, high strength material such as metal or a plastic such as acrylonitrile-butadiene-styrene (ABS). If the components of the device are fabricated of metal, it is preferable that an insulating bushing be positioned about the cord receiving slot. The pins may be integrally formed with the retaining member, particularly, if it is fabricated of a plastic material or the pins may take the form of rivets or other mechanically equivalent device if the retaining member is fabricated of a metal.

Thus is an object of the instant invention to provide a device for ensuring the retention of electrical plugs in outlets.

It is a still further object of the instant invention to provide a device which readily releases a cord and plug when removal of the plug is desired.

It is a still further object of the instant invention to provide a device for retaining electrical plugs in outlets which may be readily secured to conventional electrical outlets.

It is a still further object of the instant invention to provide a device for retaining electrical plugs in outlets which permits release of the electrical plug without the use of hand tools.

Still further objects and advantages of the instant invention will become apparent by reference to the following description of the preferred embodiment and appended drawings.

DESCRIPTION OF THE PREFERRED EMBODIMENT

Figure 1:
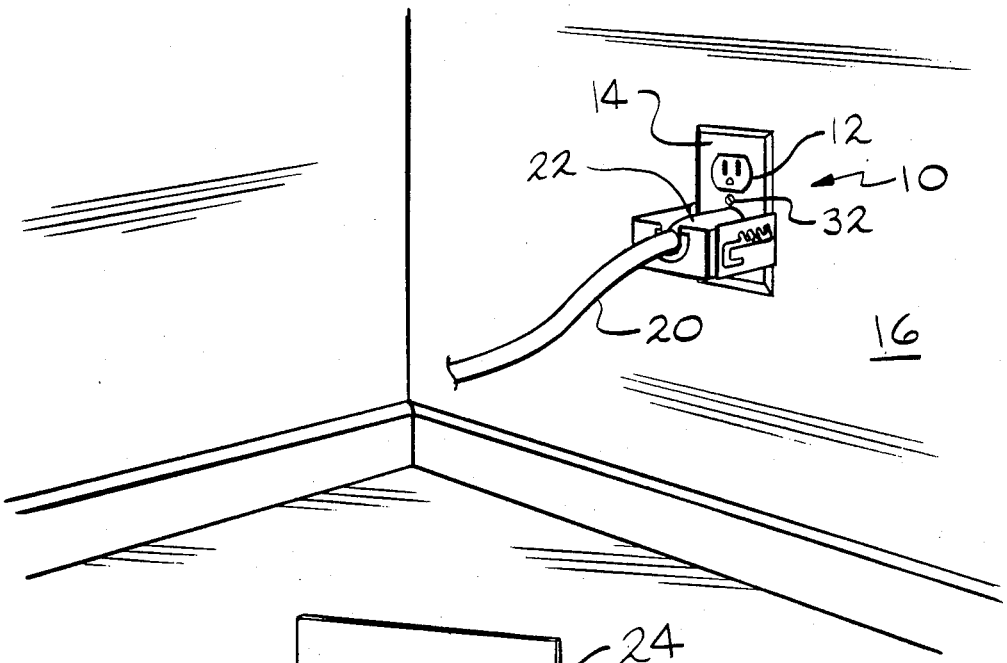
FIG. 1 is a perspective view of the present invention in place on a conventional duplex electrical outlet.
Figure 2:
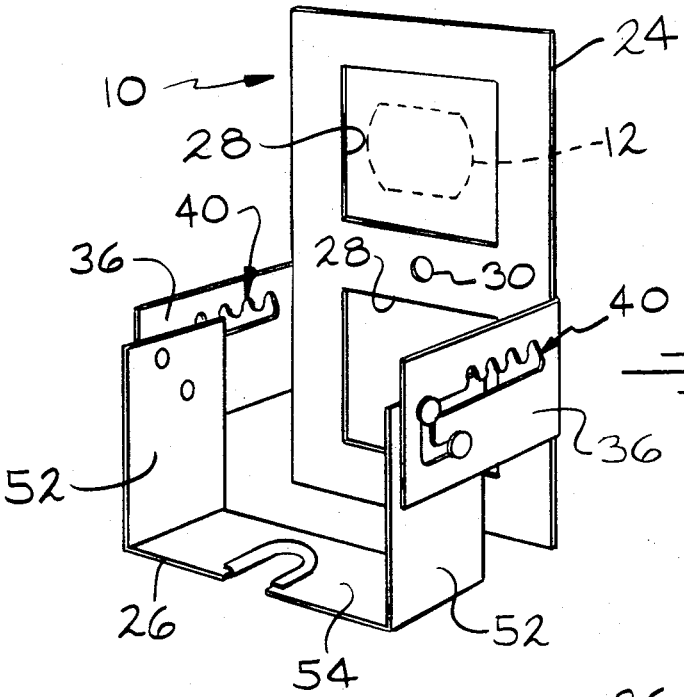
FIG. 2 is a perspective view of an electrical plug retaining device according to the present invention.

Referring now to FIGS. 1 and 2, a plug retention assembly according to the present invention is illustrated and generally designated by the reference numeral 10. The plug retention assembly 10 is preferably utilized in connection with a conventional duplex wall outlet 12 having a decorative and protective cover plate 14. The duplex outlet 12 and cover plate 14 are conventional and are typically and commonly installed in a wall 16 of a habitable structure (not illustrated). The plug retention assembly 10 according to the instant invention is utilized to retain the power cord 20 and specifically the power plug 22 in one of the outlets of the duplex outlet 12.

The plug retention assembly 10 includes a base plate 24 which is secured behind the cover plate 14 and a retaining member 26 which is movably coupled thereto. The base plate 24 is preferably rectangular and defines a pair of apertures 28 which extend about each of the outlets of the duplex outlet 12 and permit access thereto. A centrally disposed aperture 30 receives a screw 32 which secures the cover plate 14 to the duplex outlet 12. The base plate 24 also includes a pair of arms 36. The arms 36 extend perpendicularly from the base plate 24 along the two longer marginal edges thereof and are oriented perpendicularly to the plane of the base plate 24.

Figure 4:
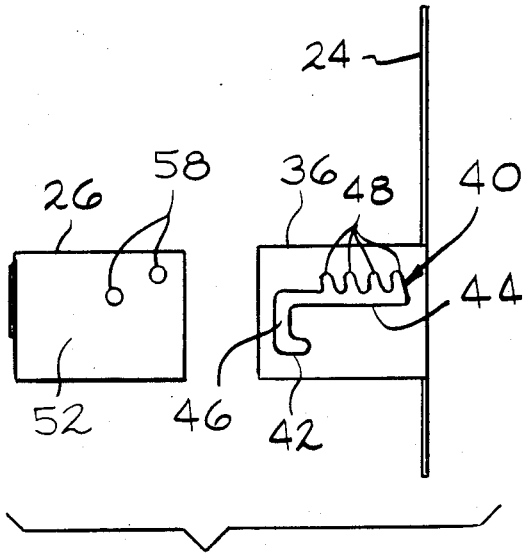
FIG. 4 is an exploded, side elevational view of an electrical plug retaining device according to the present invention.

Referring now to FIGS. 2 and 4, each of the arms 36 defines a complexly configured J-shaped slot 40. Each of the slots 40 preferably defines a foot portion 42 and a parallel channel portion 44 which are interconnected by a central portion 46. The channel portion 44 includes a plurality of obliquely oriented blind slots or channels 48. The channels 48 are preferably parallel and have their ends opposite the foot portion of the slot 42 farther from the base plate 24 than the ends of the channels 48 nearest the foot portion 42. The channels are preferably oriented an acute angle of between 20° and 40° relative to the base plate 24.

Figure 3:
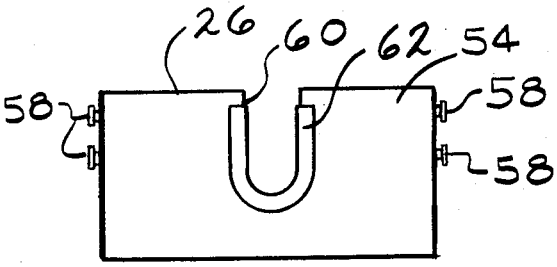
FIG. 3 is an end, elevational view of the plug retaining member of an electrical plug retaining device according to the present invention.

As illustrated in FIGS. 2, 3 and 4, the retaining member 26 is generally rectangularly U-shaped and includes two parallel sidewalls 52 and a central cord and plug retaining region 54. The sides 52 are parallel and spaced apart a distance equal to the internal spacing of the arms 36 of the base plate 24. Thus, the retaining member 26 and specifically the sides 52 are slidably received between the arms 36 of the base plate 24 is illustrated in FIG. 2. Each of the sides 52 includes a pair of outwardly extending pins 58. The pins 58 may be rivets, threaded fasteners, or the pins 58 may be integrally formed with the retaining member 26. The pins 58 have heads with diameters greater than the width of the slots 40 and standoffs with a diameter slightly less than that of the slots 40 such that pins 58 are slidably received within the slot 40 and also retain the retaining member 26 on the arms 36 of the base plate 24. If the pins 58 are integrally formed with the retaining member 26 from a thermoplastic material such as polystyrene, the retaining member 26 may be assembled to the base plate 24 and the pins 58 heated to form appropriately sized heads. Finally, the central region 54 of the retaining member 26 defines a deep recess or slot 60 which receives the cord 20 as illustrated in FIG. 1. If the retaining member 26 is fabricated of metal or other electrically conductive material, it is preferable that an insulating bushing material 62 be placed within the slot 60 to ensure electrical isolation of the retaining member 26 from the power cord 20 if it should be damaged or frayed.

In order to utilize the cord retaining assembly 10 of the present invention, the screw 32 is moved from the duplex outlet 12 and the decorative cover plate 14 is also removed. Then, the base plate 24 is positioned over the duplex outlet 12 such that the outlets are accessible through the apertures 28. The cover plate 14 and machine screw 32 are then re-attached to the duplex outlet 12. The retaining member 26 is then positioned as illustrated in FIG. 2 and a cord 20 and specifically an electrical plug 22 is plugged into the duplex outlet 12. Next, the retaining member 26 is pivoted upwardly, generally about the axes defined by the pins 58. The retaining member 26 is then moved toward the base plate 24 until it engages the plug 22. At this time, the pins 58 closest to one of the oblique channels 48, are moved into either that pair of channels or the pair of channels next farther from the base plate 24 to secure the plug 22. It will be readily appreciated that the cooperation between the pins 58 and the channels 48 inhibits motion of the retaining member 26 away from the base plate 24 thereby preventing removal of the plug 22 from the outlet 12.

In order to remove the plug 22, the pins 58 engaging the channels 48 are moved downwardly, out of the channels 48, the retaining member 26 is pulled away from the base plate 24 and returned to the position illustrated in FIG. 2. The cord 20 and plug 22 may then be readily and expeditiously removed from the duplex outlet 12.

Thus it will be appreciated that the present invention provides a positive, though readily releasable means for securing an electrical plug to an outlet. Although the device has been described and illustrated as a single plug retention device, it should be understood that it may be readily adapted by the simple addition of two more arms 36 or one wider arm on each side of the base plate 24 and an additional retaining member 26 to secure two plugs to the duplex outlet 12. The resulting device would be arranged to have an upper half which is a mirror image of the lower half of the assembly 10 illustrated in FIG. 2. That is, the upper half of the base plate 24 would include two additional arms 36 or one wider arm, having the upper slots 40 in an inverted orientation and an additional retaining member 26 also disposed in an orientation inverted from that illustrated in FIG. 2.

The foregoing disclosure is the best mode devised by the inventor for practicing this invention. It is apparent, however, that apparatus incorporating modifications and variations will be obvious to one skilled in the art of plug retaining means. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

What is claimed is:

1. A device for ensuring retention of an electrical plug in an outlet comprising, in combination, a base plate for disposition on an electrical outlet, a pair of parallel arms extending from said base plate, each of said arms defining a slot extending through said arm, each of said slots having an elongate portion extending generally away from said base plate and an end portion extending generally perpendicularly to said base plate and intersecting said elongate portion of said slot at its end most distant said base plate, each of said arms also defining a plurality of blind slots extending through said arms and oriented at an acute angle to said base plate and intersecting said elongate portion of one of said slots, and a generally U-shaped retaining member, said retaining member having pin means disposed in said slots of said arms for slidably securing said retaining member to said arms of said base plate and a centrally dispose slot means for receiving an electrical cord.

2. The plug retention device of claim 1 further including means for securing said base plate to an electrical outlet.

3. The plug retention device of claim 1 wherein said base plate defined two apertures for disposition about a respective two electrical outlets.

4. The plug retention device of claim 1 wherein said plurality of blind slots are disposed in parallel.

5. The plug retention device of claim 1 wherein said cord receiving slot means includes an insulated bushing.

6. The plug retention device of claim 1 wherein said retaining member is rectangularly U-shaped and includes a pair of parallel arms disposed adjacent said arms of said base plate.

7. The plug retention device of claim 1 wherein said pin means for slidably securing said retaining member to said arms are a plurality of circular structures secured to said retaining member having an enlarged head portion and a reduced diameter body portion.

8. A device for ensuring retention of an electrical plug in an outlet comprising, in combination, a base plate having a pair of opposed edges for disposition on an electrical outlet having opening means for providing access to an electrical outlet, a pair of parallel arms extending perpenicularly from said edges of said base plate, each of said arms defining a first slot extending away from said base plate, each of said arms also defining a plurality of oblique slots intersecting said first slot, and a generally U-shpaed retaining member, said retaining member having pin means disposed in said slots of said arms for slidably securing said retaining member to said arms of said base plate and a centrally disposed slot for receiving an electrical cord.

9. The plug retention device of claim 8 further including means for securing said base plate to an electrical outlet.

10. The plug retention device of claim 8 wherein said plurality of oblique slots are disposed in parallel.

11. The plug retention device of claim 8 wherein said pin means includes a plurality of pins having a head with a diameter greater than the width of said slots.

12. The plug retention device of claim 8 wherein said opening means defines at least one aperture for disposition about an electrical outlet.

* * * * *